US006974349B2

(12) United States Patent
Tsai

(10) Patent No.: US 6,974,349 B2
(45) Date of Patent: Dec. 13, 2005

(54) ELECTRICAL CARD CONNECTOR HAVING A BEVEL SLOT

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 10/761,602

(22) Filed: Jan. 20, 2004

(65) Prior Publication Data

US 2004/0152361 A1 Aug. 5, 2004

(51) Int. Cl.[7] ..... H01R 13/15; H01R 24/00
(52) U.S. Cl. ..... 439/630; 439/260
(58) Field of Search ..... 439/630, 60, 260, 439/267, 325, 329

(56) References Cited

U.S. PATENT DOCUMENTS 4,810,203 A * 3/1989 Komatsu ..... 439/326
5,066,241 A * 11/1991 Hills ..... 439/260
5,613,866 A * 3/1997 Niimura ..... 439/260
6,120,328 A * 9/2000 Bricaud et al. ..... 439/630
6,210,193 B1 * 4/2001 Ito et al. ..... 439/326
6,361,350 B2 * 3/2002 Johnson et al. ..... 439/374
2004/0106317 A1 * 6/2004 Koser ..... 439/325

* cited by examiner

*Primary Examiner*—Chandrika Prasad
(74) *Attorney, Agent, or Firm*—Pro-Techtor Int'l Services

(57) ABSTRACT

An electrical card connector includes a base and plural rows of terminals each having a contact and a connection. The base is formed with a plurality of slots having different widths or heights and sharing a common space, and an insert port for the plurality of slots is formed at a front end of the base. The contact, which is elastic and positioned within the base, is to be connected to an electrical card. One of the slots is a bevel slot that is tilted inwardly and downward from the insert port.

4 Claims, 6 Drawing Sheets

ELECTRICAL CARD CONNECTOR HAVING A BEVEL SLOT

BACKGROUND OF THE INVENTION

1. Field of the Invention

The invention relates to an electric connector, and more particularly to an electrical card connector having a bevel slot.

2. Description of the Related Art

The electrical cards used in a computer include multimedia storage cards and memory cards, wherein the memory cards in the current market have various specifications, such as those of a Secure Digital Card (SDC), a Muti-Media Card (MMC), a Smart Media Card (SMC), a Memory Stick Card (MSC), a Compact Flash Card (CFC), and the like. Because the positions of connection points of the memory cards with different specifications are different, the electrical connectors for the memory cards with different specifications are different.

In order to facilitate the usage, the manufacturers try to integrate various kinds of electrical connectors into an integrated electrical connector suitable for various memory cards with different specifications. Because several memory cards with different specifications have to be integrated, the integrated electrical connector has to be provided with several kinds of terminals for the memory cards with different specifications. Thus, the number of the terminals is quite great. It is difficult to design a light and thin electric connector, so there is no complete product design.

Referring to FIG. 1, a conventional electric connector includes a base 11, a row of first terminals 12 coupled to a MSC 17, and a row of second terminals 13 coupled to a SDC 18, wherein the base 11 has a top board 14 and a bottom board 15.

In the prior art design, the following problems will be caused when the product is to be designed as a thin and light one. Because the connection points 19 of the SDC 18 are more concave than the bottom surface, the contact points 21 of the second terminals 13 have to be designed higher such that they may be in good contact with the connection points 19 of the SDC 18, as shown in FIG. 2, which shows the connection state after the SDC 18 is inserted. However, as shown in FIG. 3, when the MSC 17 is inserted and its connection points 20 are connected to the first terminals 12, the second terminals 13 will be over depressed because the MSC 17 is quite thick and its bottom surface in contact with the second terminals 13 has no concave portion. Consequently, if the bottom board 15 is made too thin, the second terminals 13 will be pressed out of the bottom board 15, thereby causing poor influence in the usage. However, if the second terminals 13 are configured no to be pressed out of the bottom board 15, the connector inevitably cannot be made thin and light.

SUMMARY OF THE INVENTION

It is therefore an object of the invention to provide an electrical card connector, into which an electrical card is slantly inserted so that the heights of the connection points may be reduced.

Another object of the invention is to provide a thin and light electrical card connector, into which various electrical cards may be inserted.

The invention achieves the above-mentioned objects by providing an electrical card connector having a bevel slot. The electrical card connector includes a base and plural rows of terminals each having a contact and a connection. The base is formed with a plurality of slots having different widths or heights and sharing a common space, and an insert port for the plurality of slots is formed at a front end of the base. The contact, which is elastic and positioned within the base, is to be connected to an electrical card. One of the slots is a bevel slot that is tilted inwardly and downward from the insert port.

According to the above-mentioned structure, it is possible to lower the heights of the connection points of the electrical card that is inserted into the bevel slot for connection, and the effects of thin and light product may be achieved.

DETAILED DESCRIPTION OF THE INVENTION

Figure 1:
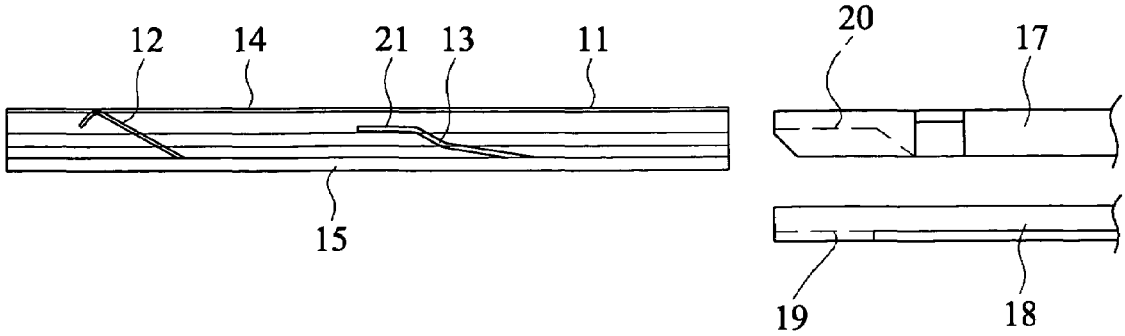
FIG. 1 (Prior Art)
FIG. 1 is a schematic illustration showing a conventional electrical card connector.
Figure 2:
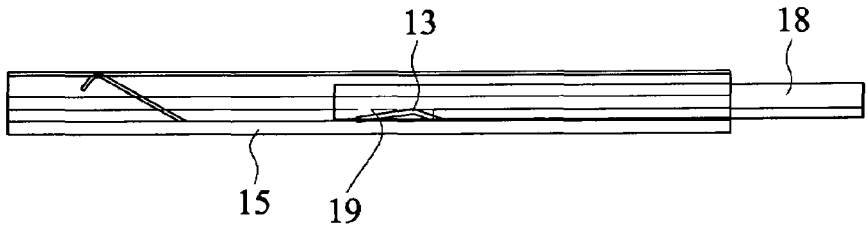
FIG. 2 (Prior Art)
FIG. 2 is a schematic illustration showing the conventional electrical card connector, into which the SDC is inserted.
Figure 3:
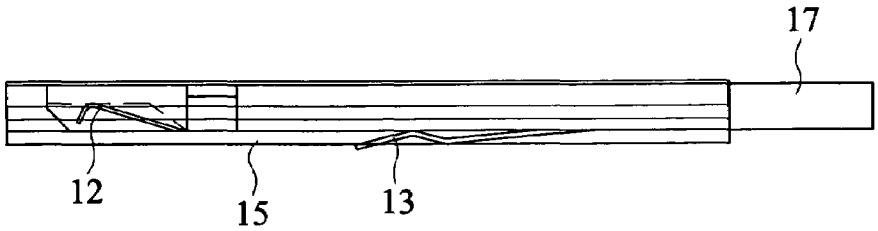
FIG. 3 (Prior Art)
FIG. 3 is a schematic illustration showing the conventional electrical card connector, into which the MSC is inserted.
Figure 4:
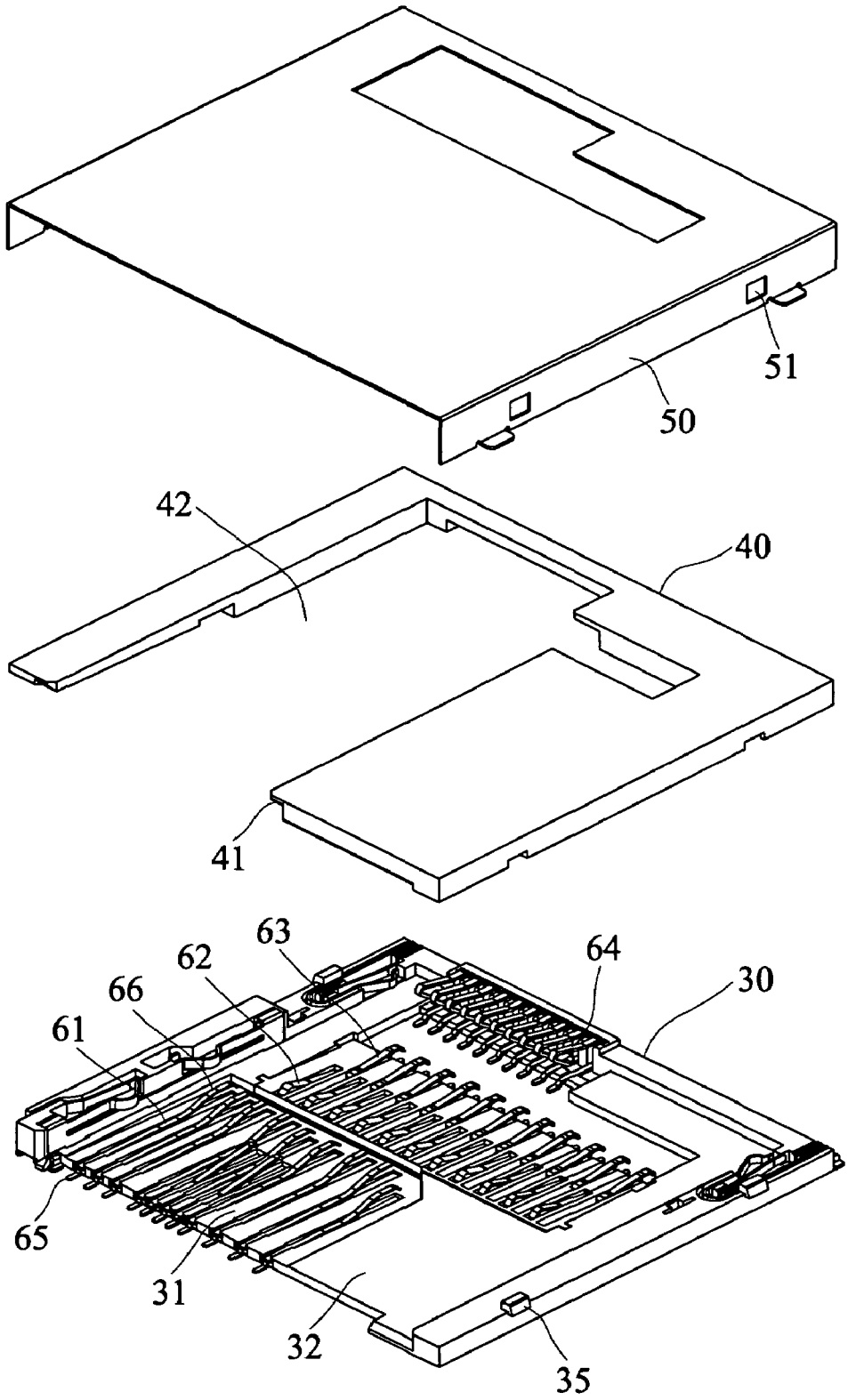
FIG. 4 is a pictorially exploded view showing a first embodiment of the invention.
Figure 5:
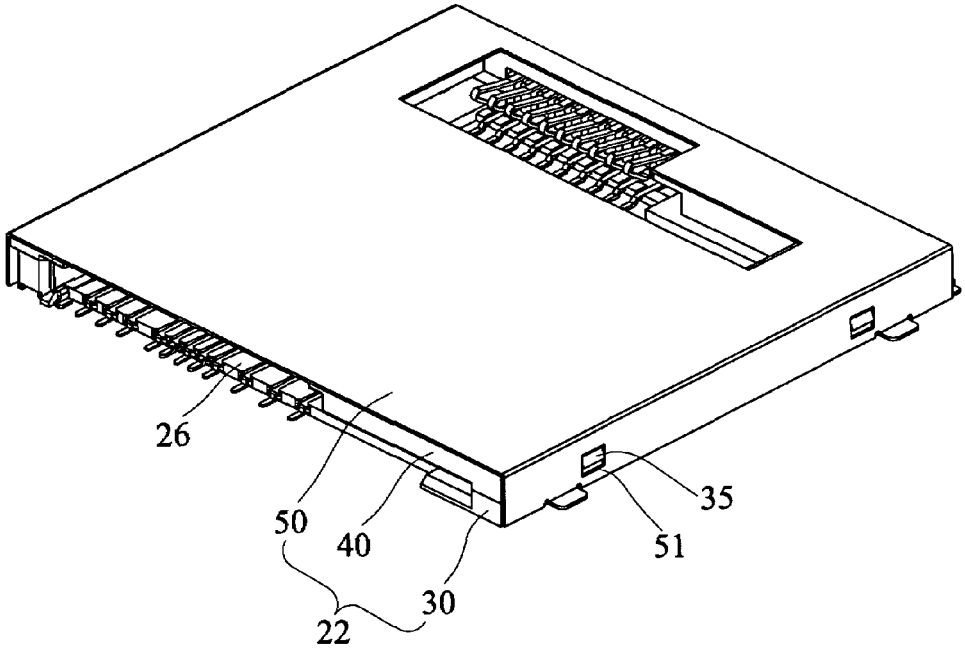
FIG. 5 is a pictorially assembled view showing the first embodiment of the invention.
Figure 6:
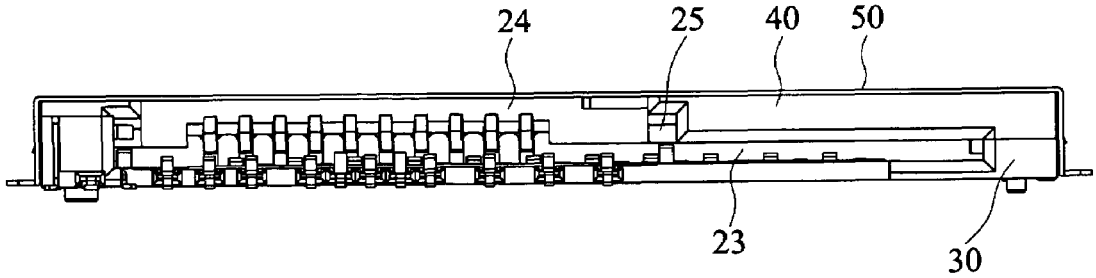
FIG. 6 is a front view showing the first embodiment of the invention.
Figure 7:
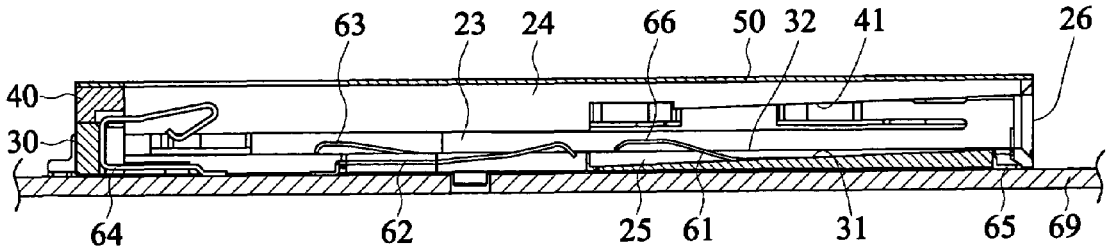
FIG. 7 is a side view showing the first embodiment of the invention.

Referring to FIGS. 4 to 7, an electrical card connector of the invention includes a base 22, a row of first terminals 61, a row of second terminals 62, a row of third terminals 63, and a row of fourth terminals 64.

The base 22 is formed with an insert port 26 at a front end thereof. The base 22 has a bottom base 30, a middle board 40, and an upper cover 50. The bottom base 30 has a first concave surface 31 and a second concave surface 32. The first concave surface 31 is more concave than the second concave surface 32 and is gradually tilted inwardly and downward from the insert port 26. In addition, the bottom base has engagement blocks 35 at two sides thereof. The middle board 40 is placed on a top of the bottom base 30. A first convex surface 41 is formed on a bottom surface of the middle board 40, and an opening 42 is formed at the central portion of the middle board 40. The first convex surface 41 is gradually tilted inwardly and downward from the insert port 26 and is tilted corresponding to the first concave surface 31. The upper cover 50 is a metal housing and has engagement holes 51 at two lateral sides thereof. The upper cover 50 covers over the middle board 40 and its engagement holes 51 are engaged with the engagement blocks 35 of the bottom base 30. The bottom base 30, the middle board 40, and the upper cover 50 are assembled to form a first slot 23, a second slot 24, and a third slot 25, all of which have different widths or heights, and the insert port 26 for the plurality of slots is formed at the front end. The slots share a common space, wherein the third slot 25 is a bevel slot composed of the tilted first convex surface 41 and first concave surface 31.

The first terminals 61, the second terminals 62, the third terminals 63, and the fourth terminals 64 are arranged on the bottom base 30. Each terminal has a contact 66 and a connection 65. The contact 66 is elastic, positioned within the base, and connected to the inserted electrical card. The connections 65 extend to a lower edge of the base, and are to be connected to a printed circuit board 69. The contacts 66 of the first terminals 61 are positioned in the third slot 25 and electrically connected to the SDC. The second terminals 62 and the third terminals 63 are electrically connected to the SMC, and the fourth terminals 64 are electrically connected to the MSC.

Figure 8:
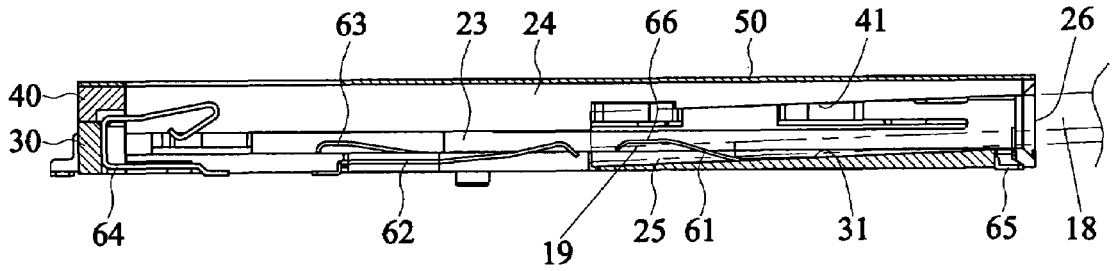
FIG. 8 is a side view showing the first embodiment of the invention, into which the SDC is inserted.

According to the above-mentioned structure, the third slot 25 is concave toward the inner surface of the bottom base 30 to form the bevel slot, as shown in FIG. 8. So, the SDC 18 will slant downward along the bevel slot when it is inserted into the third slot 25, and the heights of the connection points 19 of the SDC 18 after the SDC 18 is slantly inserted will be lower than those after the SDC 18 is horizontally inserted. Thus, the connection points 19 of the SDC 18 may be electrically connected to the contacts of the first terminals 61. According to the bevel slot design of the third slot 25, the contacts 66 of the first terminals 61 may be electrically connected to the connection points 19 on the concave bottom surface of the SDC 18 without being particularly risen. As shown in FIG. 8, when the MSC 17 is inserted, the contacts 66 of the first terminals 61 are not particularly higher than the contacts of the second and third terminals 62 and 63. So, it is possible to prevent the contacts 66 of the first terminals 61 from being over pressed by the bottom surface of the MSC 17 to cause great displacements or make them extend out of the bottom surface of the bottom base 30.

The invention having the above-mentioned structure has the following advantages.

1. Because the third slot 25 is a concave bevel slot in the bottom base 30, the heights of the connection points 19 of the SDC 18 may be reduced when the SDC 18 is slantly inserted. Thus, the heights of the concave connection points 19 on the bottom surface of the SDC 18 may be offset.

2. Because the contacts 66 of the first terminals 61 does not need to be risen, it is possible to prevent the contacts 66 from being pressed by the MSC 17 to cause great displacements when the MSC 17 is inserted. Therefore, the bottom surface of the bottom base 30 may be made thinner, thereby achieving the effects of the light and thin product.

Figure 9:
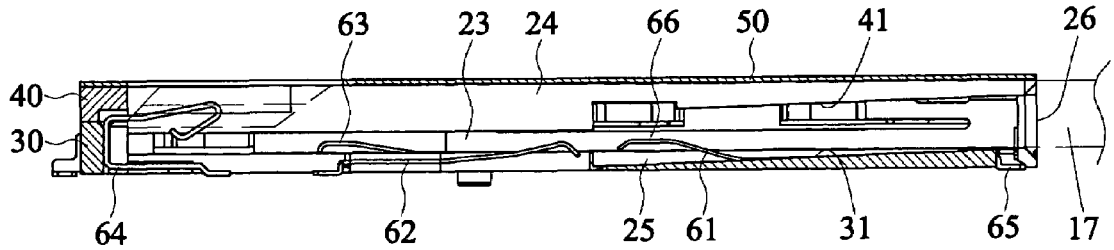
FIG. 9 is a side view showing the first embodiment of the invention, into which the MSC is inserted.
Figure 10:
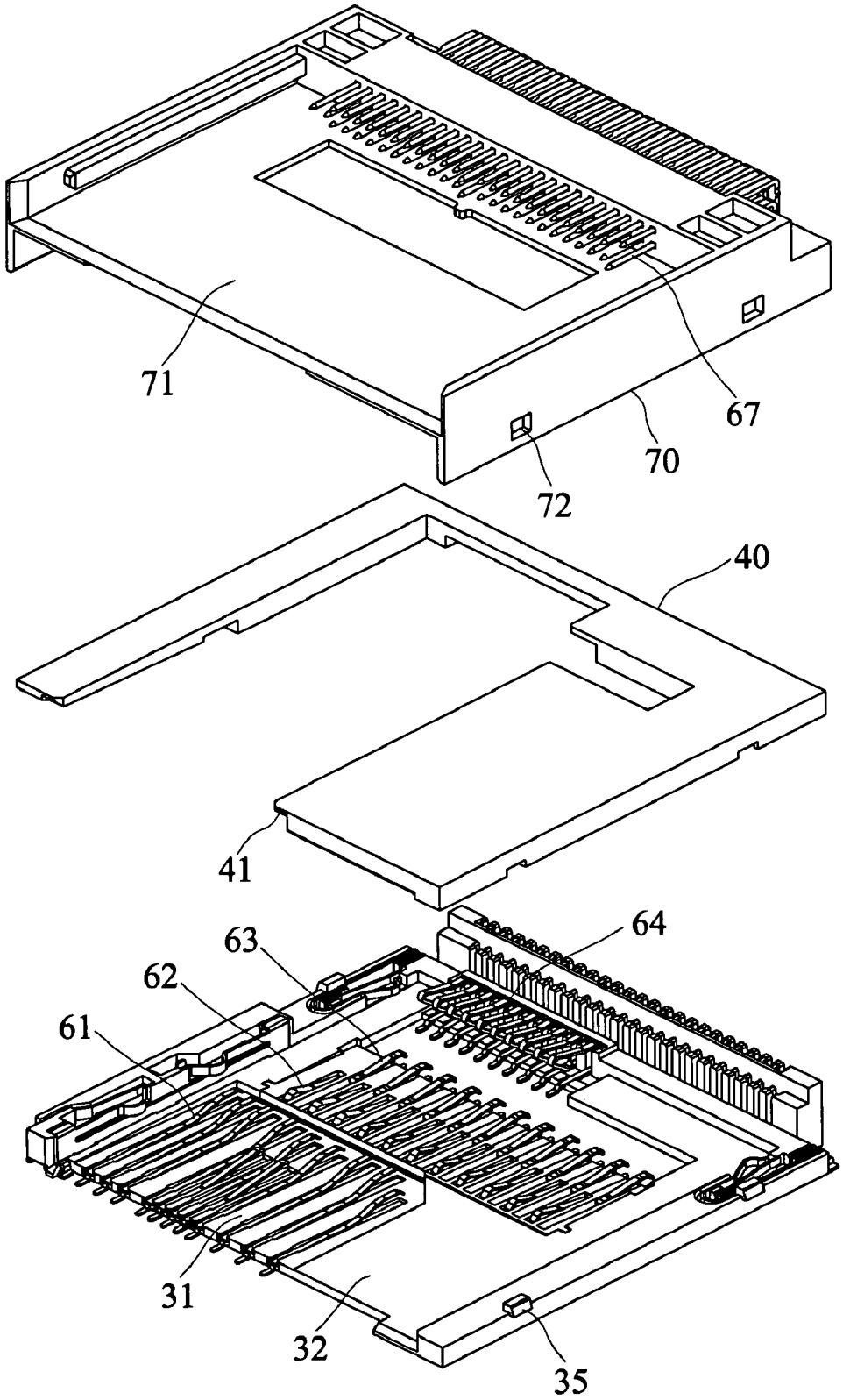
FIG. 10 is a pictorially exploded view showing a second embodiment of the invention.
Figure 11:
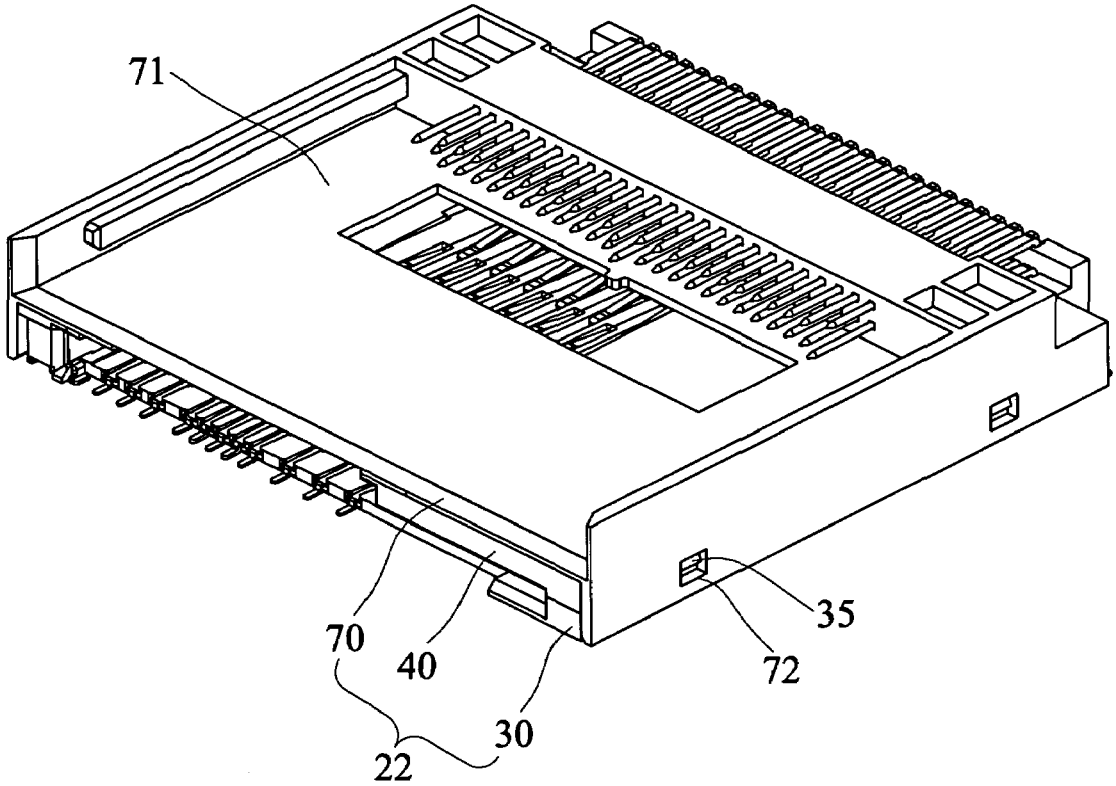
FIG. 11 is a pictorially assembled view showing the second embodiment of the invention.

As shown in FIGS. 9 and 10, the second embodiment of the invention is substantially the same as the first embodiment, wherein the base 22 has a bottom base 30, a middle board 40, and a top base 70. The bottom base 30 has a first concave surface 31 and a second concave surface 32. The first concave surface 31 is more concave than the second concave surface 32 and is gradually tilted inwardly and downward from the insert port. In addition, the bottom base has engagement blocks 35 at two sides thereof. The middle board 40 is placed on the top of the bottom base 30, and a first convex surface 41 on the bottom surface of the middle board 40. The first convex surface is gradually tilted inwardly and downward from the insert port and corresponds to the first concave surface 31. The top base 70 is arranged on the middle board 40 and has an upper slot 71, on which two rows of fifth terminals 67 are arranged. In addition, engagement holes 72 to be engaged with the engagement blocks 35 of the bottom base 30 are formed at two sides of the top base 70.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An electrical card connector, comprising:

a base formed with a plurality of slots having different widths or heights and sharing a common space, and an insert port for the plurality of slots being formed at a front end of the base; and plural rows of terminals each having a contact and a connection, the contact, which is elastic and positioned within the base, being to be connected to an electrical card, wherein one of the slots is a bevel slot that is tilted inwardly and downward from the insert port, the base has a bottom base, the bottom base has a first concave surface and a second concave surface, the first concave surface is more concave than the second concave surface, and the first concave surface is gradually tilted inwardly from the insert port.

2. The electrical card connector according to claim 1, wherein:

the base further has a middle board and an upper cover;

the first concave surface is gradually tilted inwardly and downward from the insert port;

the middle board is arranged on a top of the bottom base;

a first convex surface is formed on a bottom surface of the middle board;

the first convex surface is gradually tilted inwardly and downward and corresponds to the first concave surface; and the upper cover covers over the middle board.

3. The electrical card connector according to claim 2, wherein the upper cover is a metal housing.

4. The electrical card connector according to claim 1, wherein:

the base further has a middle board and a top base;

the first concave surface is gradually tilted inwardly and downward from the insert port;

the middle board is arranged on a top of the bottom base;

a first convex surface is formed on a bottom surface of the middle board;

the first convex surface is gradually tilted inwardly and downward from the insert port, and corresponds to the first concave surface; and the top base is arranged on the middle board and has an upper slot.

* * * * *